US008979618B2

(12) United States Patent
Nowak et al.

(10) Patent No.: US 8,979,618 B2
(45) Date of Patent: Mar. 17, 2015

(54) POLISHING TOOL FOR PROCESSING OPTICAL SURFACES

(75) Inventors: Gerd Nowak, Neresheim (DE); Michael Zaiser, Boebingen (DE)

(73) Assignee: Carl Zeiss Vision GmbH, Aalen (DE)

( * ) Notice: Subject to any disclaimer, the term of this patent is extended or adjusted under 35 U.S.C. 154(b) by 528 days.

(21) Appl. No.: 13/097,700

(22) Filed: Apr. 29, 2011

(65) Prior Publication Data

US 2011/0275295 A1 Nov. 10, 2011

Related U.S. Application Data

(60) Provisional application No. 61/329,937, filed on Apr. 30, 2010.

(30) Foreign Application Priority Data

Apr. 30, 2010 (DE) ..... 10 2010 019 491

(51) Int. Cl.
*B24B 13/01* (2006.01)
*B24D 3/00* (2006.01)
*B24B 13/00* (2006.01)

(52) U.S. Cl.
CPC . *B24D 3/00* (2013.01); *B24B 13/00* (2013.01); *Y10S 451/921* (2013.01)
USPC ..... 451/548; 451/527; 451/921

(58) Field of Classification Search
CPC ..... B24B 13/00; B24B 13/01; B24B 13/02; B24B 13/012
USPC ..... 451/42, 43, 921, 527, 548
See application file for complete search history.

(56) References Cited

U.S. PATENT DOCUMENTS

| | | | | | |
|---|---|---|---|---|---|
| 342,493 | A | * | 5/1886 | Badger | 451/550 |
| 642,355 | A | * | 1/1900 | McLeod | 451/550 |
| 689,933 | A | * | 12/1901 | Underwood | 451/42 |
| 2,649,667 | A | | 8/1953 | Cooke | |
| 3,144,737 | A | * | 8/1964 | Faas | 451/538 |
| 3,255,555 | A | * | 6/1966 | Heyman | 451/540 |
| 3,583,111 | A | * | 6/1971 | Volk | 451/490 |

(Continued)

FOREIGN PATENT DOCUMENTS

| | | |
|---|---|---|
| DE | 44 42 181 C1 | 10/1995 |
| DE | 101 00 860 A1 | 8/2001 |

(Continued)

OTHER PUBLICATIONS

"Point." Vocabulary.com. Dec. 19, 2013. <https://www.vocabulary.com/dictionary/point>.*

(Continued)

*Primary Examiner* — Lee D Wilson
*Assistant Examiner* — Joel Crandall
(74) *Attorney, Agent, or Firm* — Harness, Dickey & Pierce, P.L.C.

(57) ABSTRACT

A polishing tool for processing an optical surface of a spectacle lens, having a carrier body and a polishing film, an elastic layer being arranged between said polishing film and said carrier body. Further, there is provision for a surface of said polishing film, which surface is active during processing, to decrease in size in an edge region of said polishing film outwards in said radial direction. Furthermore, an apparatus is provided for polishing an optical surface of a spectacle lens having a polishing tool as described above.

13 Claims, 4 Drawing Sheets

(56) References Cited

U.S. PATENT DOCUMENTS

| | | | | |
|---|---|---|---|---|
| 3,594,963 | A * | 7/1971 | Beasley | 51/293 |
| 3,699,721 | A * | 10/1972 | Beasley | 451/550 |
| 3,959,935 | A * | 6/1976 | Stoppacher | 451/527 |
| 4,274,232 | A * | 6/1981 | Wylde | 451/490 |
| 4,288,233 | A | 9/1981 | Wiand | |
| 4,291,508 | A * | 9/1981 | Prunier | 451/527 |
| 4,733,502 | A * | 3/1988 | Braun | 451/42 |
| 4,962,618 | A * | 10/1990 | Wylde | 451/527 |
| 5,000,761 | A * | 3/1991 | Mayton et al. | 51/295 |
| 5,095,660 | A * | 3/1992 | Dillon | 451/163 |
| 5,287,662 | A * | 2/1994 | Weis et al. | 451/527 |
| 5,384,988 | A * | 1/1995 | Hernandez | 451/42 |
| 6,089,963 | A * | 7/2000 | Wiand et al. | 451/390 |
| 6,645,059 | B1 * | 11/2003 | Roberts et al. | 451/443 |
| 6,796,877 | B1 * | 9/2004 | Bingham et al. | 451/5 |
| 6,942,554 | B1 * | 9/2005 | Mandina | 451/165 |
| 7,223,164 | B2 | 5/2007 | Bernard et al. | |
| 7,413,503 | B2 * | 8/2008 | Tabata et al. | 451/42 |
| 7,503,834 | B2 | 3/2009 | Kuebler et al. | |
| 7,559,829 | B2 * | 7/2009 | Stephane et al. | 451/512 |
| 2005/0042978 | A1 * | 2/2005 | Brost | 451/495 |
| 2006/0094341 | A1 | 5/2006 | Schneider et al. | |
| 2008/0171502 | A1 | 7/2008 | Stephane et al. | |
| 2009/0081933 | A1 * | 3/2009 | Oliver et al. | 451/539 |

FOREIGN PATENT DOCUMENTS

| | | | |
|---|---|---|---|
| DE | 101 06 007 | A1 | 8/2002 |
| DE | 102 42 422 | A1 | 4/2003 |
| DE | 10 2005 010 583 | A1 | 9/2006 |
| DE | 60 2004 008 920 | T2 | 4/2008 |
| EP | 0 567 894 | A1 | 11/1993 |
| EP | 1 644 160 | B1 | 9/2007 |
| FR | 2 900 356 | | 11/2007 |
| GB | 2230487 | A * | 10/1990 |
| WO | WO 2005/068133 | A1 | 7/2005 |

OTHER PUBLICATIONS

European Patent Office; European Search Report; dated Aug. 19, 2014; 4 pp.

European Patent Office; English language translation of European Search Report; dated Aug. 19, 2014; 4 pp.

* cited by examiner

POLISHING TOOL FOR PROCESSING OPTICAL SURFACES

CROSS-REFERENCE TO RELATED APPLICATIONS

This application claims the priority of German patent application DE 10 2010 019 491.3, filed Apr. 30, 2010, and of U.S. provisional application No. 61/329,937, filed Apr. 30, 2010. The entire contents of these priority applications are incorporated herein by reference.

BACKGROUND OF THE INVENTION

The present invention relates to a polishing tool for processing an optical surface of a spectacle lens, having a carrier body and a polishing film, an elastic layer being arranged between the polishing film and the carrier body.

Furthermore, the present invention relates to an apparatus for processing optical surfaces having a polishing tool of this type.

Spectacle lenses are conventionally produced from a semi-finished product by material-removing or abrasive processing of what is known as the prescription surface or surfaces. The optically relevant shape of the spectacle lens is therefore fixed. Finally, the spectacle lens is also polished; no change in the optical properties of the spectacle lens may be brought about by the polishing, however.

In order to polish a surface of a spectacle lens, a polishing head is usually used which has a polishing tool, the polishing surface of which is adapted at least approximately to a shape of that surface of the spectacle lens which is to be polished. The polishing tool and/or the spectacle lens are/is mounted in an articulated manner, in particular by way of a ball joint, and are guided relative to one another with a predefined movement sequence, usually with the aid of CNC systems.

When spherical or toric spectacle lenses are polished, it is less problematical, on account of the relatively simple shape of the surface to be polished, to find a suitable polishing tool of complementary configuration which can be guided over the surface with simple movement sequences which does not bring about any impermissible deformations. On account of the multiplicity of possible spherical or toric spectacle lenses, it is merely required to keep a corresponding multiplicity of polishing tools available.

Similar polishing tools of this type are shown, for example, in documents DE 101 00 860 A1, EP 0 567 894 B1, DE 44 42 181 A1, DE 102 42 422 or DE 101 06 007 A1.

A common feature of these polishing tools is that a pressing rigidity which extends in a radial direction of the polishing tool is either constant or decreases slightly from the inside to the outside. The flexural rigidity of the polishing tool therefore decreases from the inside to the outside in a direction, in which a force is loaded onto the spectacle lens by the polishing tool, or is constant.

This is sufficient for spherical and toric, that is to say simply shaped, surfaces. When what are known as freeform surfaces or aspherical or point symmetrical, arbitrarily shaped surfaces are polished, polishing tools of this type cannot be used without problems, in contrast.

Aspherical or point symmetrical surfaces and freeform surfaces have curvatures which change over the surface. In particular, freeform surfaces of this type are used in individual spectacle lenses which are adapted to a user. During the polishing processing of freeform surfaces of this type, the polishing tool moves at least over a part of this irregularly curved surface. The flexural stability or elasticity of the polishing tool therefore has to be capable of being adapted to the respective local curvature, to be precise in such a way that the polishing pressure is as constant as possible over the contact surface. Only then does this result in a definable constant abrasion, and the polished surface is polished uniformly. If this is not ensured, the surface or the topography of the freeform surface is deformed and its optical quality is impaired as a result.

For mass polishing processing of freeform surfaces and also of spherical or toric spectacle lenses from plastic materials, inexpensive polishing tools of simple construction are used according to the currently known prior art. The plastic materials of the spectacle lenses are, for example, a polycarbonate, for instance CR 39 which is marketed by the company PPG Industries, Pittsburgh, USA. The polishing tools usually comprise an at least three layer construction. The polishing tools have at least one fixed basic body which faces the tool spindle which rotates the polishing tool, and on which basic body a foam layer or other elastic layer is adhesively bonded or attached. A polishing film which faces the spectacle lens or workpiece is in turn provided on said foam layer. On account of the elastic deformability of the foam layer, the polishing film can be adapted by a certain amount to the topography of the spectacle lens surface to be polished. In order to assist the capability of the polishing surface of the polishing tool to be adapted to the surface of the spectacle lens, the polishing tools are generally smaller than the spectacle lens. The polishing abrasion is produced with the aid of an abrasive polishing liquid by the relative movement of the polishing tool which is loaded with pressure.

An example of a polishing tool similar to this type of polishing tools which also makes the application of a polishing liquid possible is shown in document DE 10 2005 010 583 A1.

For a polishing tool which is high quality under optical aspects, it is important that the polishing force which is applied to the glass by the tool decreases in the edge region of the polishing surface of the polishing tool toward the outside, ideally moves continuously toward zero. If this is not ensured sufficiently, visible spiral structures which are caused by the edge of the polishing tool, impair the quality of the spectacle lens surface and can even make it unusable are produced on the polished glass.

As a solution for this, it has been proposed in the prior art, for example, to configure foam layers with a lower hardness in the edge region, for instance by an increase in the material thickness, and as an alternative or cumulatively to allow the polishing film to protrude beyond the edge of the foam layer. A similar solution is shown, for example, in document EP 1 644 160 B1.

The aim of a pronounced decreasing polishing force in the edge region of the tool cannot be achieved sufficiently, however, by way of this proposed solution. As a result, depending on the selection of the polishing parameters, cosmetic defects are nevertheless produced on the spectacle lens. These faults on the optical surface can be tolerated or not as a function of the quality demands made on the spectacle lenses to be produced. These problems are reinforced by material fatigue in the case of long-lasting use of the polishing tool. If the material is subject to fatigue in the zone of the greatest loading, which zone lies between the centre and the edge in the above-described solutions, the polishing force is in turn increased in the edge zone and causes the undesirable effect in a reinforced manner.

It is a further observed effect that the polishing foil becomes wavy after multiple use of the polishing tool and accumulates in the direction of the glass surface, as a result of which polishing errors can be produced. This can take place by the diffusing of liquid polishing medium into the edge region of the polishing film and the swelling of the porous material which is caused as a result. Cosmetic defects can also be caused by polishing medium which is caked and embedded in the edge region.

It has been proposed as a further solution approach to use a polishing film with a relatively low material thickness and a resulting relatively low mechanical stability.

Finally, this solution permits only material thicknesses which oppose a requirement for high loadability and a long service life of the polishing film. Sufficiently stable polishing films are required for high efficiency of the polishing process and high resistance to mechanical wear.

Finally, polishing tools with different, pneumatically actuable pressure zones have also been proposed. Ultimately, however, said polishing tools require a structurally complicated construction which is once again expensive and prone to maintenance. Furthermore, the pressure zones cannot have as fine a resolution as desired, with the result that there is frequently, despite everything, no sufficient control over the pressure conditions, in particular in critical edge regions. One example for a similar approach of this type is shown in document US 2006/0094341 A1.

It is therefore an object of the present invention to provide a polishing tool for the improved processing of optical surfaces, in particular freeform surfaces.

SUMMARY OF THE INVENTION

According to one aspect of the invention, there is provided a polishing tool for processing an optical surface of a spectacle lens, having a carrier body and a polishing film, an elastic layer being arranged between the polishing film and the carrier body, wherein a surface of the polishing film, which surface is active during processing, decreases in size in an edge region of the polishing film towards the outside in the radial direction.

In this way, it is possible to influence the force which acts on the optical surface in the edge region. Although the pressure which is loaded on the optical surface is also substantially constant in the edge region, the force which acts likewise becomes lower to the outside as a result of the active surface which decreases to the outside. Furthermore, the flexural rigidity of the polishing film and therefore that of the polishing tool can be reduced towards the outside as a result of the decreasing active surface. This effect can be implemented particularly effectively in a polishing film which protrudes beyond the elastic layer in the radial direction, since the flexural rigidity of the polishing tool radially to the outside from the elastic layer is then determined solely by the polishing film.

In this way, the material abrasion which is generated under the polishing film can be influenced in the edge region in a targeted manner and can be reduced to virtually zero towards the edge.

As will still be explained in the following text, a refinement of this type of the edge region also leads to a substantially enlarged circumferential length of a contour of the polishing tool. As a result, more intensive exchange of liquid polishing medium between the optical surface and the polishing film is made possible during the polishing process. As a result, advantageous stabilization of the lubrication is achieved.

Here, an "optical surface" is to be understood to mean all optical surfaces of spectacle lenses, in particular aspherical surfaces or freeform surfaces. In principle, however, the optical surface can be spherical and toric surfaces, point symmetrical aspheres or freeform surfaces. Here, the optical surface can be both convexly and concavely curved. Furthermore, the polishing tool can be used for processing both plastic spectacle lenses and mineral spectacle lenses.

Here, the expression "polishing film" is to be understood as that element of the polishing tool which acts on the optical surface, that is to say that part or that element of the polishing tool which comes into contact with the optical surface, optionally with the aid of a liquid polishing medium. The expression "polishing film" is not to be understood as restrictive in any regard, in particular with regard to the thickness or another design of the polishing film or a polishing element.

According to a further aspect of the invention, there is provided an apparatus for polishing optical surfaces having a polishing tool for processing an optical surface of a spectacle lens, having a carrier body and a polishing film, an elastic layer being arranged between the polishing film and the carrier body, wherein a surface of the polishing film, which surface is active during processing, decreases in size in an edge region of the polishing film towards the outside in the radial direction.

The apparatus, therefore, has the same advantages as the polishing tool.

There can be provision in a refinement for that the surface of the polishing film, which surface is active during processing, decreases continuously in size down to zero in the edge region of the polishing film towards the outside in the radial direction.

In the context of this description, the expression "edge region" is to be understood as that region of the polishing tool, in which the edge elements are provided, as will still be explained in detail in the following text. The polishing tool is not configured with a full surface area in the edge region, but rather has interruptions in the active surface between the edge elements. Expressed in relative terms, the width of the edge region can be from approximately 5% to 20% of the external diameter of the polishing tool. The dimensioning of the edge region will likewise be described in even greater detail in the following text.

In this way, a uniform decrease in the active surface can be brought about in the radial direction to the outside. It goes without saying that it is not obligatorily necessary that the active surface decreases continuously to the outside. Regions can also be provided, in which the active surface remains constant or else decreases suddenly.

Here, there can be provision in a refinement, in particular, for a continuous transition to zero to be provided at an outer edge of the polishing tool, that is to say for no sudden decrease in the active surface to zero to be provided.

There can be provision in a refinement for the polishing tool to be configured for loading a force in a defined direction onto the optical surface to be processed, a flexural rigidity of the polishing tool decreasing in the defined direction in the radial direction to the outside. The "defined direction" extends perpendicularly with respect to the active surface of the polishing film.

In this way, the force distribution can be set further in the edge region. In particular, it is thus possible to allow the force which acts on the optical surface towards the outside to be reduced further. However, it is not obligatorily necessary that the flexural rigidity of the polishing tool decreases in the defined direction to the outside. For example, there can merely be provision for a side of the polishing film, which side faces the optical surface, to be set back only partially.

Although the active surface can be reduced in this way, since the setback proportion of that surface of the polishing film which points to the optical surface does not come into contact with the optical surface, the mechanical strength or flexural rigidity can be maintained substantially. If complete apertures are provided in the polishing film and also in the elastic layer and the spectacle body, it is possible, for example, both to reduce the active surface and to allow the flexural rigidity to decrease.

There can be provision in one refinement for the edge region to be delimited in the radial direction on the inside by a base circle.

In this way, a circular shape results as basic shape of the polishing tool. The polishing tool can be configured with a full surface area in the interior of the base circle. As an alternative, however, cut-outs can also be provided there, in particular slots which point away from the centre of the base circle in a star-shaped manner, in order to increase the elasticity of the polishing tool to the outside. For example, six slots having a width in each case of approximately from 1.5 mm to 2.0 mm can be provided.

Furthermore, there can be provision in a refinement for a multiplicity of edge elements to extend in the radial direction to the outside from the base circle.

By means of the edge elements, it becomes possible in a simple way to implement the requirement for an active surface of the polishing film, which active surface decreases in the radial direction to the outside. It is possible, in particular, to form the edge elements by way of corresponding recesses from the polishing film, the elastic layer and the carrier body, for example by material-removing processing.

There can be provision in a refinement, in particular, for a contour of each edge element to end radially towards the outside at an end point.

In this way, it can be implemented particularly simply that the polishing film decreases constantly to zero in the radial direction to the outside.

This criterion is satisfied in edge elements which end radially towards the outside at an end point. There should advantageously not be provision for an edge element to end radially on the outside at more than one point, that is to say, for example, at a tip line or the like. This reduces the advantageous effect which is achieved according to the invention.

Furthermore, there can be provision in a refinement for the edge region to be delimited in the radial direction towards the outside by a tip circle, the end point of at least one edge element lying on the tip circle.

There can be provision in a refinement, in particular, for the end point of each edge element to lie on the tip circle.

The edge elements can therefore protrude radially to the outside from the base circle to the same extent or to different extents. This solution which is very simple technically results when the edge elements are formed in such a way that their end points all lie on the tip circle.

It goes without saying that there can also be provision in a further refinement for some shorter edge elements to be provided between longer edge elements, with the result that the end points do not all lie on the tip circle, but rather end points are also arranged within the edge region, that is to say between the base circle and the tip circle.

There can be provision in a refinement, in particular, for the edge elements to extend for at least two millimeters in the radial direction, in particular approximately four millimeters.

This spacing then corresponds to the difference in the radius of the tip circle and the radius of the base circle. Expressed in relative terms, this difference in the radius of tip circle and base circle can correspond to approximately from 5 to 20% of the radius of the tip circle, in particular approximately from 10 to 15%.

There can be provision in a refinement for flanks of the edge elements to be configured as teeth.

Furthermore, there can be provision in a further refinement for the edge elements to be configured as evolvents.

Shapes which are known, for example, from the production of pinions therefore result for the edge elements. Accordingly, the manufacturing-technology measures which are known there can also be adapted simply. Furthermore, with regard to the meaning of the expressions "tooth", "flank" and "evolvent", reference is made to the understanding of an average person skilled in the art of gearwheels and pinions.

In order to produce the desired contours of the polishing film, a routine cutting apparatus, for example, can be provided, for instance a CNC water-jet or laser-beam cutting machine, or else a corresponding punching apparatus. As an alternative, abrasive manufacturing measures are also conceivable.

There can be provision in a refinement for an angle between mutually adjoining flanks of two adjacent edge elements to lie between approximately 5° and 180°, in particular between 40° and 150°, in particular between 70° and 120°; in particular, the angle can be 10°, 15°, 20°, 25°, 30°, 35°, 40°, 45°, 50°, 55°, 60°, 65°, 70°, 75°, 80°, 85°, 90°, 95°, 100°, 105°, 110°, 115°, 120°, 125°, 130°, 135°, 140°, 145°, 150°, 155°, 160°, 165°, 170°, 175°.

In the extreme case where the angle between adjoining flanks of two adjacent edge elements is 180°, a square can correspondingly result as contour of the polishing tool. The base circle then correspondingly forms an inner circle which is drawn inside the square, and an outer circle of the square which is drawn through the corners of the square forms the tip circle. This then results in four edge regions.

Furthermore, there can be provision in a refinement for it to be possible for a composite contour of the edge elements to be described in the circumferential direction as a sine function. As an alternative, it goes without saying that every other regularly or irregularly curved contour can also be provided in such a way that the surface which acts during the processing decreases in the radial direction to the outside.

It is therefore not obligatorily necessary that the edge elements are configured, for example, as tines or teeth and an angle is arranged between the flanks. It is also possible in a further refinement that a sine function results for the contour in the circumferential direction, that is to say the contour is of undulating configuration. The amplitude and the frequency of the contour can be adapted, in order to achieve a corresponding distribution of the active surface. Here, what was said for the radial extent of the edge elements can apply to the amplitude, that is to say a double amplitude can be from approximately 5% to approximately 20% of the radius of the tip circle. The frequency can be selected in such a way that the describing sine function performs more than two, in particular from three to fifteen, in particular from five to ten, in particular two, three, four, five, six, seven, eight, nine, ten, fifteen, twenty or more oscillations over the circumference.

In particular, in a refinement there can be provision for the polishing tool to be configured for processing free-form surfaces.

The advantages according to the invention become apparent, in particular, during the processing of freeform surfaces. A polishing tool which is provided for processing freeform surfaces is distinguished by a sufficient ability to be adapted to the spectacle lens. This ability is achieved firstly by an elastic construction and secondly by a diameter which matches the spectacle lens and a curvature of the tool which is adapted to the polished surface.

In all the exemplary embodiments and refinements described in the preceding text, an external diameter of the polishing tool, that is to say a diameter of the tip circle, can be from approximately 40 mm to approximately 60 mm, in particular approximately from 45 mm to 50 mm. Here, a diameter of the elastic layer can be configured to be smaller than a diameter of the polishing film, that is to say the polishing film protrudes to the outside beyond an edge of the elastic layer. For example, an external diameter of the elastic layer can be 40 mm and an external diameter of the polishing film can be 45 mm. The external diameter of the polishing tool is usually selected in such a way that a ratio of the external diameter of the polishing tool to an external diameter of the spectacle lens is approximately from 0.5 to 1.0. However, the ratio can also be greater than 1.0.

In all the exemplary embodiments and refinements, a thickness of the elastic layer in an axial direction can be from approximately 6 mm to approximately 12 mm, in particular 8 mm. An axial thickness of the polishing film is from approximately 0.5 mm to approximately 2.0 mm, polishing films for pre-polishing rather being of thin configuration, that is to say approximately from 0.5 to 0.8 mm, and polishing films for fine polishing rather being of thick configuration, that is to say approximately from 1.2 to 1.8 mm.

It goes without saying that the features which are mentioned in the preceding text and will still be explained in the following text can be used not only in the respectively specified combination, but also in other combinations or alone, without departing from the scope of the present invention.

BRIEF DESCRIPTION OF THE DRAWINGS

Exemplary embodiments of the invention are shown in the drawing and will be explained in greater detail in the following description. In the drawing.

DETAILED DESCRIPTION OF THE PREFERRED EMBODIMENTS

Figure 1:
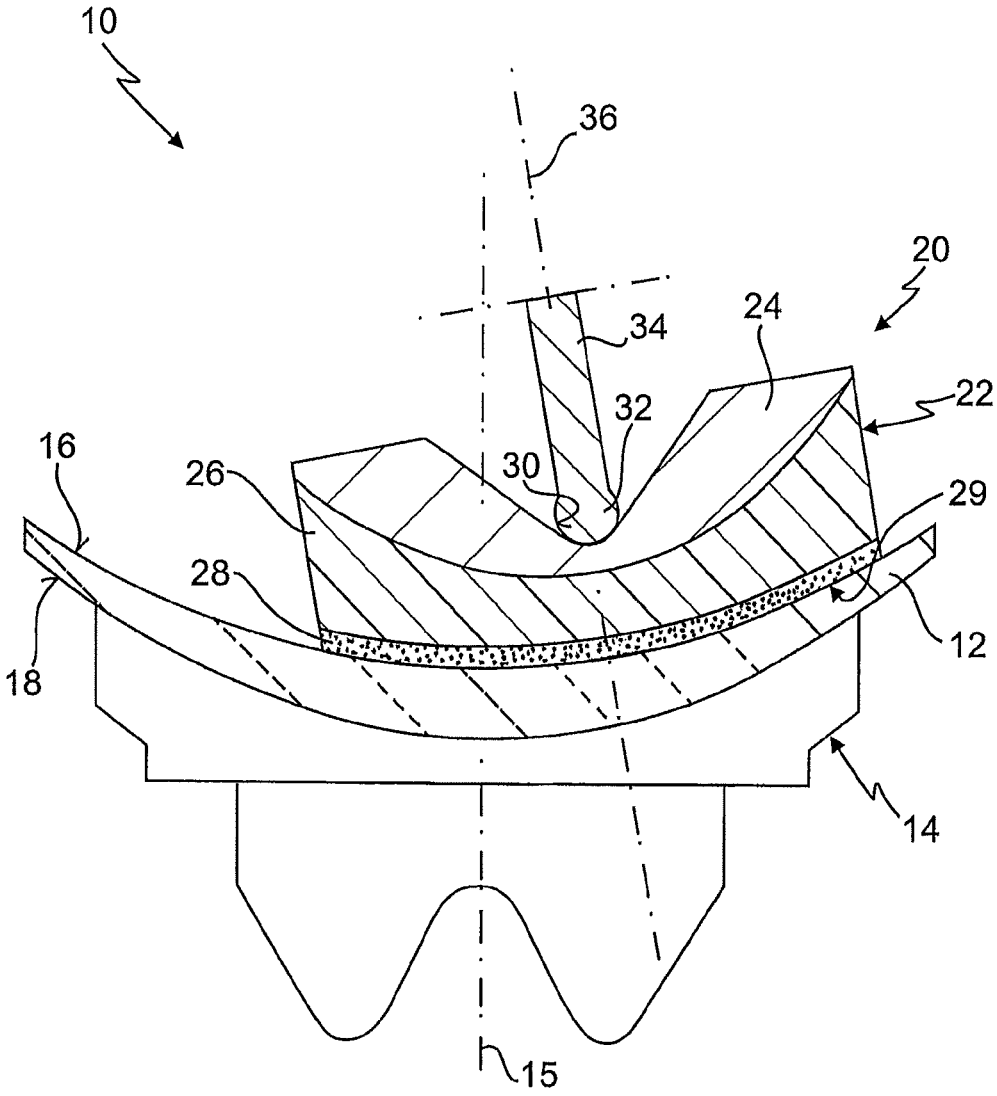
FIG. 1 shows one embodiment of an apparatus for polishing optical surfaces in a diagrammatic cross-sectional view.

FIG. 1 shows an apparatus (denoted in general by a reference numeral 10) for processing a spectacle lens 12. It goes without saying that the application of a spectacle lens is to be understood in the following text merely by way of example. It goes without saying that the advantages of this apparatus can also be used for polishing other optical components having spherical and aspherical or toric optical surfaces or freeform surfaces.

The spectacle lens 12 is held in a holder 14. The holder 14 can be arranged in a spatially fixed manner about a first axis 15.

The spectacle lens 12 has a rear surface 16 and a front surface 18. In the present case, the rear surface 16 is configured as a prescription surface, that is to say as that surface which is processed optically in a predefined manner and is configured, in particular, as a freeform surface. It goes without saying that there can additionally be provision for the front surface 18 to be provided additionally with an optical effect, for example with a predefined addition.

A polishing head 20 is provided which has a polishing tool 22 at its free end. The polishing tool 22 has a carrier body 24, an elastic layer 26 and a polishing film 28. Here, the elastic layer 26 is provided between the substantially rigid carrier body 24 and the polishing film 28. The elastic layer 26 can have an increasing thickness, for example, radially to the outside, in order to provide an increasing elasticity at their outer ends.

In addition, openings (not shown) can be provided in the elastic layer 26 and the polishing film 28, in order to load the optical surface 16 with a polishing liquid or a polishing medium.

Accordingly, an active surface 29 of the polishing film 28 is in sliding contact with the optical surface 16 of the spectacle lens 12.

The carrier body 24 has a ball socket 30, in which a spherical head 32 of an actuator 34 is arranged. The actuator brings it about that the polishing tool 22 rotates about a second axis 36 and, moreover, can be pivoted about the spherical head 32. A rotational speed about the second axis 36 is usually approximately from 1200 to 1500 revolutions per minute, but it can also be lower or higher in individual cases. Instead of a ball joint, as an alternative, a cardan joint can also be provided, possibly in combination with a surrounding folding bellows or a similar element. In addition to the rotation about the second axis 36, a movement about the first axis 15 is provided, with the result that the optical surface 16 is swept over completely and polished. An axial movability of the polishing tool depends on a tool receptacle (not shown) and can be from approximately 2 to approximately 5 mm, for example, in the case of a tool receptacle with a folding bellows.

The elastic layer 26 preferably comprises vulcanized rubber or natural rubber. However, it can also comprise a polyurethane material, for example polyurethane or polyether urethane. Materials of this type are known and can be obtained, for example, under the commercial names Sylomer, Sylodyn and Sylodamp. A modulus of elasticity of the elastic layer should be greater than 0.02 $N/mm^2$.

In addition to the shown central arrangement of the second axis 36 relative to the polishing tool 22, an eccentric arrangement of the second axis relative to the polishing tool 22 can also be provided, in order to bring about an additional rotational movement of the polishing tool on the spectacle lens 12.

Possible refinements of the polishing tool 22 will now be explained in detail using the following figures.

Figure 2:
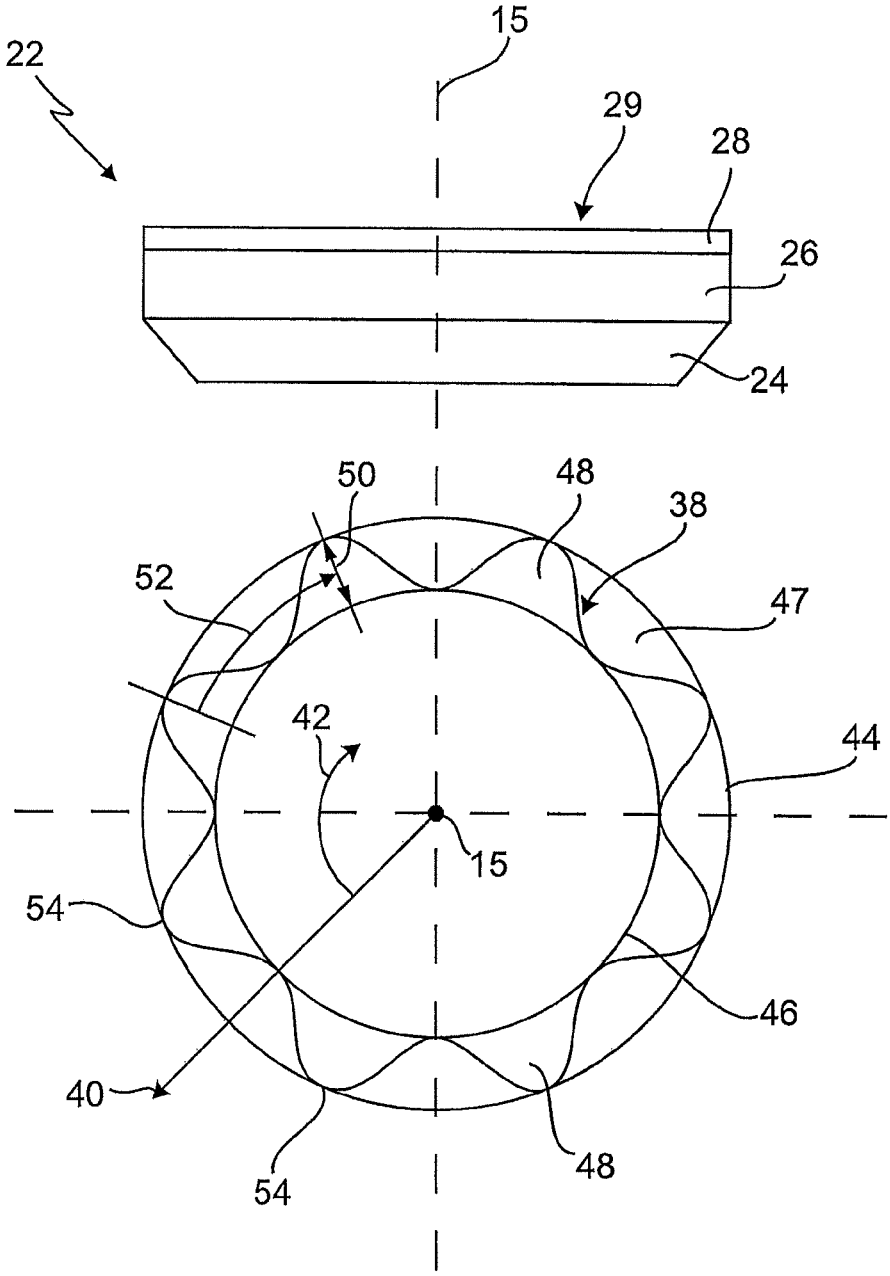
FIG. 2 shows a first embodiment of a polishing tool.

FIG. 2 shows a first embodiment of a polishing tool 22. In a customary manner, the polishing tool has the carrier body 24, the elastic layer 26 and the polishing film 28, as has already been shown in FIG. 1.

The profile of a contour 38 of the polishing tool 22 is shown in a diagrammatic top view. A radial direction is labeled by a reference numeral 40, and a circumferential direction is labeled by a reference numeral 42.

There is provision in the embodiment which is shown for it to be possible for the composite contour 38 to be described in the circumferential direction 42 as a sine function.

The contour 38 extends between a tip circle 44 and a base circle 46 which together delimit an edge region 47. As a result, the edge region 47 marks the region of the polishing tool 22, in which the active surface 29 of the polishing tool 22 decreases in the radial direction 40 to the outside.

In other words, the active surface 29 within the base circle 46 is completely closed in the exemplary embodiment which is shown; that is to say, the active surface 29 is provided over a complete arc angle of 360°. If one moves from the base circle 46 in the radial direction 40 to the outside to the tip circle 44 and determines the composite arc angle of the active surface 29, the active surface 29 or the composite arc angle decreases increasingly in the direction of the tip circle 44 and tends towards zero.

The structural design of the active surface 29 is realized using a plurality of edge elements 48. On account of the sinusoidal contour 38, the edge elements 48 correspondingly have an undulating profile. This therefore results in a double amplitude which is denoted by the reference numeral 50 and a double frequency which is denoted by the reference numeral 52 for the edge elements 48.

The edge elements 48 lie in each case with only an end point 54 on the tip circle 44. This achieves a situation where the active surface 29 on the tip circle does not drop suddenly to zero, but tends continuously towards zero.

Figure 3:
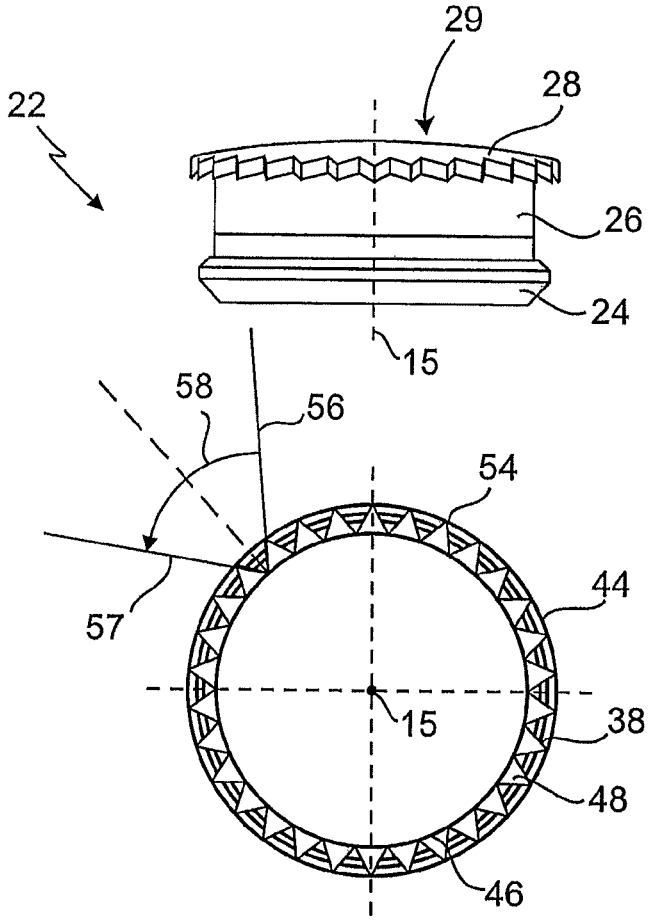
FIG. 3 shows a second embodiment of a polishing tool.

FIG. 3 shows a further possible embodiment of the polishing tool 22. In this embodiment, the edge elements 48 are configured as tines, so that the result is a shape for the polishing tool 22 which is similar to a pinion.

Each edge element 48 or each tine likewise has an end point 54, which all lie on the tip circle 44. Adjacent tooth flanks 56, 57 of two edge elements 48 enclose an angle 58. This angle can lie between approximately 5° and 180°; it is approximately 80° in the case which is shown.

Apart from the tine shape which is shown in FIG. 3, it goes without saying that all other shapes of teeth are conceivable, for example evolvents, as are also known from the production of pinions. However, there should be provision, in particular, for the selected shapes of the edge elements 48 to end radially on the outside at an end point 54, without this being necessary, however. The end points 54 preferably all lie on the tip circle 44.

Figure 4:
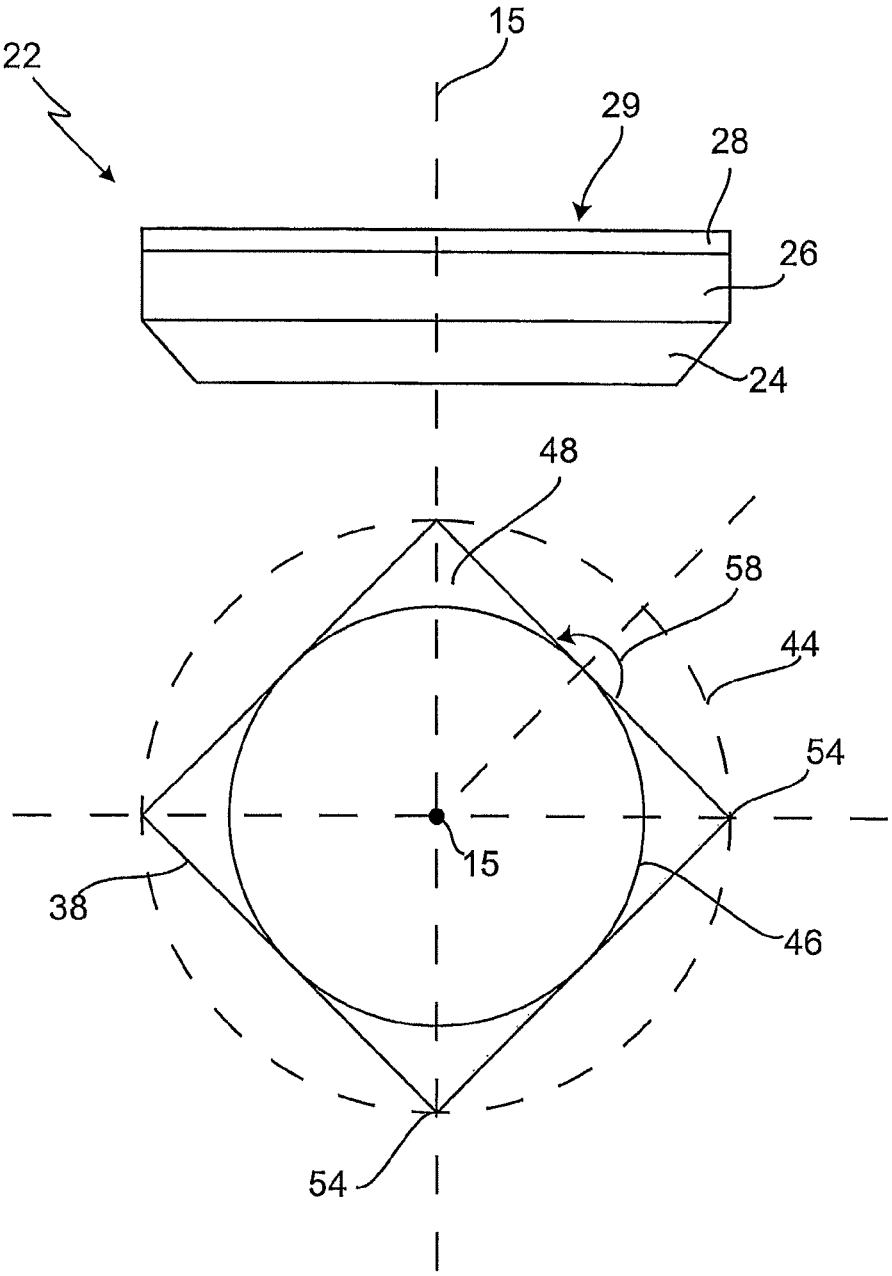
FIG. 4 shows a third embodiment of a polishing tool.

FIG. 4 shows a further embodiment which represents a special case of the embodiment which is shown in FIG. 3. In the embodiment which is shown in FIG. 4, the angle 58 is exactly 180°. The result for the contour 38 of the polishing tool 22 is therefore a square shape in the present case. In this case, the base circle 46 forms an inner circle of the square and the tip circle 44 forms an outer circle which extends through the corners of the square. The corners of the square then form the end points 54 which lie on the tip circle 44. Just this contour 38 of the polishing tool 22 or the active surface 29 of the polishing tool 22 can provide the advantages according to the invention and can significantly improve the cosmetic quality of polished freeform surfaces.

What is claimed is:

1. A polishing tool for processing an optical surface of a spectacle lens, having a carrier body that is rotated during processing about a central axis and a polishing film, an elastic layer being arranged between said polishing film and said carrier body for elastically pressing the polishing film against the optical surface of the spectacle lens during processing, wherein said polishing film has an edge region, wherein said edge region is delimited inwards in a radial direction by a base circle, wherein a plurality of edge elements extend outwards in said radial direction from said base circle, wherein a surface of said polishing film, which surface is active during processing, extends from said central axis and decreases in size in said edge region of said polishing film outwards in said radial direction, wherein said surface of said polishing film, which surface is active during processing, decreases continuously in size down to zero in said edge region of said polishing film outwards in said radial direction, wherein a contour of each edge element ends radially outwards at a singular end point, wherein said edge region is delimited outwards in said radical direction by a tip circle, said singular end point of at least one edge element lying on said tip circle, wherein none of said singular end points lies beyond said tip circle, and further wherein a difference between a radius of said tip circle and a radius of said base circle is approximately from 5 to 20% of said radius of said tip circle.

2. The polishing tool according to claim 1, wherein said polishing tool is provided for loading a force in a defined direction onto said optical surface to be processed, and a flexural rigidity in said defined direction of said polishing tool decreases outwards in said radial direction.

3. The polishing tool according to claim 1, wherein said end point of each edge element lies on said tip circle.

4. The polishing tool according to claim 1, wherein said edge elements extend for at least 2 mm in said radial direction.

5. The polishing tool according to claim 1, wherein said edge elements are configured as teeth.

6. The polishing tool according to claim 1, wherein an angle which is enclosed by mutually adjoining flanks of two adjacent edge elements lies between approximately 5° and 180°.

7. The polishing tool according to claim 1, wherein a composite contour of said edge elements can be described in a circumferential direction as a sine function.

8. The polishing tool according to claim 1, wherein said polishing tool is configured for processing free-form surfaces.

9. The polishing tool according to claim 1, wherein the carrier body has a ball socket.

10. The polishing tool according to claim 1, wherein the active surface within the base circle is completely closed.

11. The polishing tool according to claim 1, wherein the polishing film protrudes to the outside beyond an edge of the elastic layer.

12. A polishing tool for processing an optical surface of a spectacle lens, having a carrier body with first and second opposite side surfaces and a polishing film, an elastic layer being arranged between said polishing film and said first side of said carrier body for elastically pressing the polishing film against the optical surface of the spectacle lens during processing, wherein said carrier body has a ball socket formed on said second side surface, wherein said polishing film has an edge region, wherein said edge region is delimited inwards in a radial direction by a base circle, wherein a plurality of edge elements extend outwards in said radial direction from said base circle, wherein a surface of said polishing film, which surface is active during processing, decreases in size in said edge region of said polishing film outwards in said radial direction, wherein said surface of said polishing film, which surface is active during processing, decreases continuously in size down to zero in said edge region of said polishing film outwards in said radial direction, and further wherein a contour of each edge element ends radially outwards at a singular end point.

13. A polishing tool for processing an optical surface of a spectacle lens, having a carrier body and a polishing film, an elastic layer being arranged between said polishing film and said carrier body for elastically pressing the polishing film against the optical surface of the spectacle lens during processing, wherein said elastic layer has an outer radial edge, wherein said polishing film has an edge region, wherein said edge region is delimited inwards in a radial direction by a base circle, wherein a plurality of edge elements extend outwards in said radial direction from said base circle, wherein a surface of said polishing film, which surface is active during processing, decreases in size in said edge region of said polishing film outwards in said radial direction, wherein said surface of said polishing film, which surface is active during processing, decreases continuously in size down to zero in said edge region of said polishing film outwards in said radial direction, wherein a contour of each edge element ends radially outwards at a singular end point, and further wherein the polishing film protrudes beyond said outer radial edge of said elastic layer.

* * * * *

UNITED STATES PATENT AND TRADEMARK OFFICE

CERTIFICATE OF CORRECTION

PATENT NO. : 8,979,618 B2
APPLICATION NO. : 13/097700
DATED : March 17, 2015
INVENTOR(S) : Gerd Nowak et al.

It is certified that error appears in the above-identified patent and that said Letters Patent is hereby corrected as shown below:

In the Claims

Column 9,

Line 65 (Claim 1), “radical” should be -- radial --.

Signed and Sealed this
Eleventh Day of August, 2015

Michelle K. Lee

Michelle K. Lee
*Director of the United States Patent and Trademark Office*